US006718715B2

(12) United States Patent
Elliott

(10) Patent No.: US 6,718,715 B2
(45) Date of Patent: Apr. 13, 2004

(54) HARDWOOD FLOOR PAD WITH IMPROVED RESTORATION CAPABILITY

(76) Inventor: Paul W. Elliott, 6598 Canton S. Boston Rd., Salem, IN (US) 47167

( * ) Notice: Subject to any disclaimer, the term of this patent is extended or adjusted under 35 U.S.C. 154(b) by 0 days.

(21) Appl. No.: 09/998,555

(22) Filed: Nov. 29, 2001

(65) Prior Publication Data

US 2002/0108340 A1 Aug. 15, 2002

Related U.S. Application Data

(60) Provisional application No. 60/253,885, filed on Nov. 29, 2000.

(51) Int. Cl.[7] ..... E04F 15/22
(52) U.S. Cl. ..... 52/403.1; 52/480
(58) Field of Search ..... 52/403.1, 480, 52/393; 248/632, 633, 678; 15/238

(56) References Cited

U.S. PATENT DOCUMENTS 2,862,255 A * 12/1958 Nelson ..... 54/403.1
3,107,377 A * 10/1963 Nathan ..... 52/403.1
5,433,052 A * 7/1995 Niese ..... 52/403

* cited by examiner

*Primary Examiner*—Carl D. Friedman
*Assistant Examiner*—Naoko Slack
(74) *Attorney, Agent, or Firm*—Wood, Herron & Evans L.L.P.

(57) ABSTRACT

A pad for a hardwood floor which has an upper layer of floorboards and a lower subfloor, and a plurality of the pads supporting the subfloor and floorboards in spaced relation above a base, each of the pads including horizontally oriented triangular openings defined by angled legs, to optimize the restoring force of the pads and thereby extend the useful life of the hardwood floor.

9 Claims, 1 Drawing Sheet

HARDWOOD FLOOR PAD WITH IMPROVED RESTORATION CAPABILITY

This application claims the benefit of provisional No. 60/253,885 filed on Nov. 29, 2000.

FIELD OF THE INVENTION

This invention relates to a compressible pad for supporting a hardwood floor, particularly a hardwood sports floor, above a base.

BACKGROUND OF THE INVENTION

For many indoor athletic venues, particularly venues where basketball is a major indoor sport, hardwood floors remain the playing surface of choice. Hardwood floors provide uniform performance characteristics over a relatively long period of time. Hardwood floors are aesthetically pleasing, and properly designed and installed hardwood floors help to minimize wear and tear on the bodies of the athletes performing on the surface.

Typically, to minimize wear and tear, hardwood sports floors provide some amount of vertical "give," or deflection, which results from the use of resilient pads which support the floor above a base. In many cases the pads are arranged in parallel rows along the bottom surfaces of a subfloor structure, and floorboards are secured to the top of the subfloor. A typical resilient hardwood floor system of this type has been sold for a number of years by the assignee of the present application, under the trademark PERMACUSHION.

With this type of floor, because the subfloor and the upper floorboards are supported in spaced relation above the base via the pads, there exists a certain amount of vertical clearance space between the under side of the subfloor and the base, thereby allowing air circulation. This helps to minimize potential problems which may otherwise be caused by the ontake or egress of moisture by the wooden floor components, either due to flooding or moisture resulting from humidity in the air.

The particular composition and structure of the pads helps to determine the overall vertical deflectability, or resiliency of the floor structure located above. That is, to provide the desired vertical deflection, prior hardwood floor pads have come in a number of different shapes and sizes. Often the pads include void spaces to accommodate some desired amount of deflection, with the void spaces opening either in the vertical direction or in horizontal direction.

But for many athletic venues, particularly in venues where the cost constraints may be greatest, the preferred hardwood floor may be a relatively simple structure of the type described above, with an upper layer of floorboards supported on a subfloor, most likely parallel spaced rows of attachment members laid end to end, and supported above a base by a plurality of uniformly distributed pads. For these floors the pads must provide a desired amount of vertical spacing above the base and vertical deflectability for the upper floor surface when the floor is in use. Also, because the weight of the subfloor and the floorboards supplies some amount of initial compression to the pads, i.e., when in a "static loaded" condition, the design, the shape and composition of the pads must take into account the degree of compression of the pad in the static loaded condition, and the further compressibility of the pad which is available when the pads are "loaded" due to additional force or weight applied to the floor above.

One commonly used pad for floors of this type includes spaced upper and lower pieces held apart by a plurality of parallel rows of vertical supports defining a plurality of parallel rows of rectangularly-shaped horizontal passages between the upper and lower pieces. The rectangularly-shaped passages within the pads provide some amount of void space to facilitate compression of the pads, to a degree determined by the material of the pad, the amount of loading to the floor, and the density and/or distribution of the pads used to support the floor. Typically, these pads are integrally molded, as by extrusion. This particular pad has proven well suitable for extended time in supporting hardwood floors in many athletic venues.

Nevertheless, as a result of testing the compressibility of these pads, particularly the restoring forces of these pads, i.e., the ability of the pad to reassume its original state, i.e., to decompress, to the static loaded condition, can be improved. For instance, with these pads, it has been experienced that in some cases the parallel longitudinal supports may buckle sideways after being subjected to excessive vertical loads, or loads over a long period of time. Moreover, because the upper layer of floorboards may expand and contract due to moisture ontake and egress, as a result of humidity changes, and because the pads usually frictionally engage the base, even in a static state the pads may be subjected to and required to withstand some horizontal sheer forces. These sheer forces may promote, or accelerate, the undesired buckling of the supports. Once buckling occurs, the pads can eventually become transformed into incompressible masses. This can significantly reduce the resiliency of the floor, or even make the resiliency negligible.

It is an object of this invention to improve the durability and to extend the life of a relatively low cost hardwood floor system of the type described above.

It is another object of the present invention to improve the restoring force, or restoring capability of the resilient pads used to support a hardwood floor in spaced relation above a base, and to do so in a relatively cost efficient manner within a given vertical profile.

It is still another object of the present invention to minimize the adverse effects on a floor system which may otherwise result from horizontal sheer forces applied to the pads by the floor components and the base.

SUMMARY OF THE INVENTION

The present invention achieves the above stated objects via a pad design which incorporates a plurality of parallel trusses, or legs, which extend between upper and lower sections of the pad, the legs being angled and offset and defining a plurality of parallel triangularly-shaped openings which extend from one side of the pad to the other, with every other triangularly-shaped opening being inverted with respect to the adjacent opening or openings.

Because each of the legs is angled to oppose the direction and the orientation of an adjacent leg or legs, this pad design better controls deformation under static loaded conditions and also under performance load conditions, when athletes are playing on the hardwood surface above. Moreover, the angled legs maximize the restoring forces of the pad, so that the pad will be better able to repeatedly resume its original static loaded condition, for an extended period of time. This translates into a longer wear life for the floor, and ultimately, lower costs.

According to the preferred embodiment of the invention, a plurality of pads are secured to the underside of attachment members, in this case sleepers, laid end to end and arranged in spaced parallel rows over a base. An upper floor surface is then secured transversely to the sleepers, preferably by fasteners such as nails. If the upper floor surface comprises a plurality of tongue and groove floorboards laid end to end, then the nails are angled to secure the floorboards to the sleepers, as is well known in the industry. With the upper layer of floorboards secured to the sleepers, the pads support the floor, i.e., the subfloor and the floorboards, in spaced relation above the base, in a static loaded condition. That is, the legs deform slightly to accommodate the weight of the floor above.

When the floor is in use, i.e., when additional weight or force is applied to the floor, the pads provide a further degree of deflectability for the floor, the delectability resulting from further vertical compression of the pads beyond the static loaded condition. When the weight or force is removed, the pads are better able to vertically decompress to restore the floor to its original static condition, due to the orientation of the angled legs and the parallel openings which are uniformly triangular in cross-sectional shape along their lengths.

Because of the improved ability of the pads to withstand vertical compression and the improved ability to decompress, over an extended period of time, the present invention reduces the need to prematurely replace a floor due to the pads becoming incompressible masses, or blobs, residing between the subfloor and the base. Also, because of the orientation and shape of the legs and the openings, the pads of this invention are better able to withstand vertical sheer forces applied to the pads by the floor components, forces which result from expansion or contraction of the floorboards.

These and other features of the invention will be more readily understood in view of the following detailed description of the drawings.

DETAILED DESCRIPTION OF THE DRAWINGS

Figure 1:
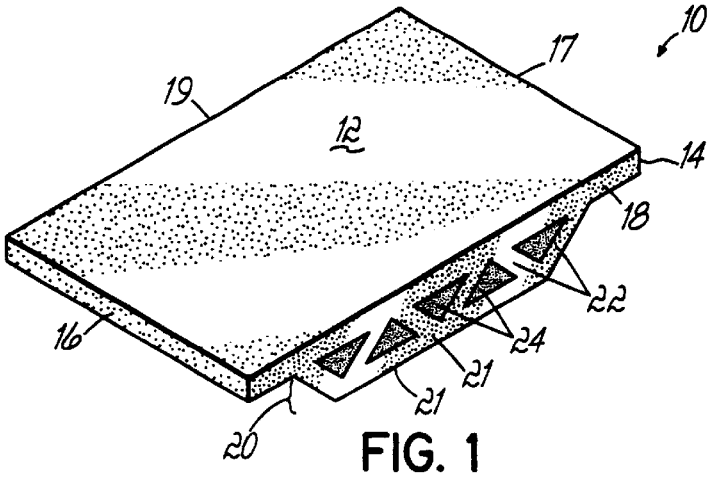
FIG. 1 is a perspective view of a low profile pad for a hardwood floor, particularly a free floating hardwood floor, in accordance with a preferred embodiment of the invention.
Figure 2:
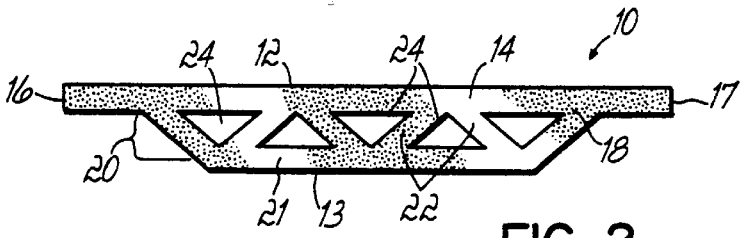
FIG. 2 is a side view of the pad shown in FIG. 1.

FIGS. 1 and 2 show a pad 10 in accordance with preferred embodiment of the invention. More specifically, FIG. 1 shows a perspective view of pad 10, while FIG. 2 shows a side view thereof.

The pad 10 is preferably of homogenous composition and molded into a desired shape in a single step molding process, such as by extrusion. While any one of a variety of different moldable materials may be used to form the pad 10, applicant's presently preferred composition is SBR (synthetic-blended rubber). The assignee of the present application obtains the pads 10 from a company called Chardon Rubber, Inc.

The pad 10 includes first and second surfaces 12 and 13, and preferably these surfaces are the top and bottom surfaces, respectively. However, the pad 10 could be inverted if desired. With reference to these Figures and this detailed description, the first and second surfaces 12 and 13 will be referred to as the top and the bottom surfaces, respectively. The pad 10 includes a first section 14, which again is preferably an upper section. This first section 14 has a uniform thickness and includes end surfaces 16 and 17 and side surfaces 18 and 19.

The pad 10 further includes a midsection 20 and a second section 21, preferably a lower section, (shown best in FIG. 2, which is a view directed at side surface 18). The second section 21 extends from side surface 18 to side surface 19. The midsection 20 includes, or is defined by, a plurality of angled legs 22 which extend from side surface 18 to side surface 19. The legs 22 define parallel openings 24 which extend in parallel from side surface 18 to side surface 19, and which are uniform and triangular in transverse cross-sectional shape along their entire lengths.

Figure 3:
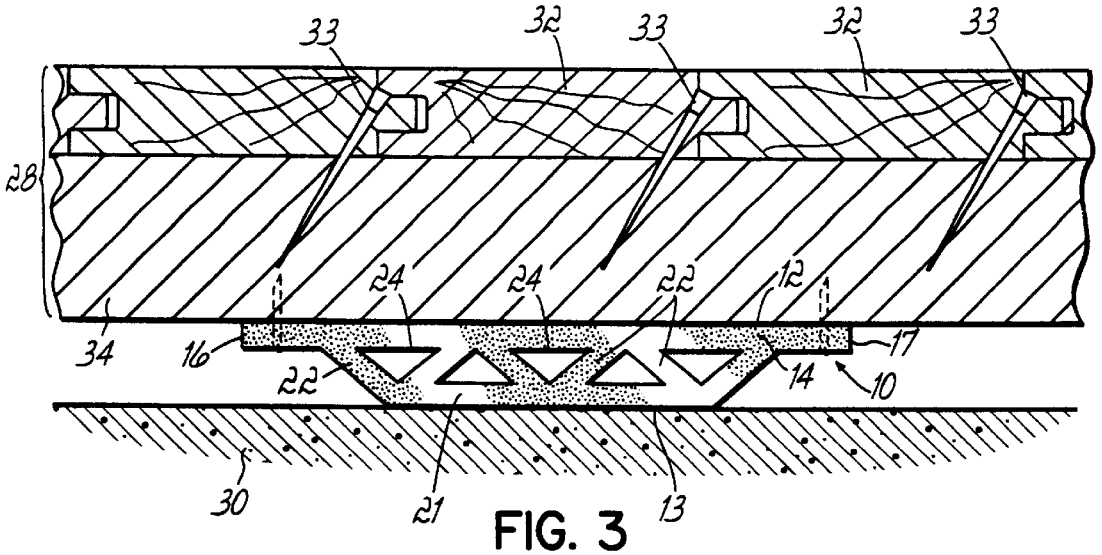
FIG. 3 is a transverse cross-sectional view of a hardwood floor supported above a base via one of the pads shown in FIGS. 1 and 2, with the pad shown in a side view.

FIG. 3 shows the pad 10 supporting a floor 28 in spaced relation above a base or substrate 30. As shown in FIG. 3, the floor 28 includes an upper layer of tongue and groove floorboards 32 secured by nails 33 to a subfloor structure 34, in this case a plurality of spaced rows of attachment members laid end to end, and oriented to transverse the floorboards 32.

As shown in FIG. 3, the bottom surface 13 of pad 10 contacts base 30, while the top surface 12 of pad 10 contacts the underside or bottom surface of the floor 28, specifically the bottom surface of sleeper 34. Fasteners 36, preferably staples, extend vertically through first section 14 and into the sleeper 34, in order to secure the pad 10 in a fixed position relative to the floor 28. Nevertheless, it is to be understood that the pad 10 does not necessarily need to be fastened to the subfloor 34 via fasteners. It could be secured to the subfloor via adhesive, or in any other secure manner. Moreover, while it is preferred that the pad 10 be secured to the subfloor 34, that is not absolutely necessary. Also, whether secured or unsecured, the pad 10 could also be inverted relative to the subfloor 34. Because the pads 10 hold the floor 28 above the substrate 30, the pads 10 help to promote air circulation between the floor 28 and the substrate 30, and also minimize moisture on-take by the floor 28.

In use, the floor 28 is said to be "loaded" in a "static" condition, i.e., the pads 10 support the weight of the floor 28 above, but nothing else. However, the further compressibility of the pads 10 enables the floor 28 to deflect downwardly toward the base 30 upon applied force or weight from above, to give the floor 28 a resilient or cushioned feel. This cushioned or resilient feel of the floor 28 minimizes the wear and tear experienced by athletes who are using the floor 28. The pads 10 provide resiliency for the floor 28 at a relatively low cost, because the pads 10 are relatively simple to manufacture, relatively simple to secure to the sleepers 34 and relatively easy to install at the site.

When the floor 28 is acted upon from above, for instance by the foot of an athlete stepping on the floorboards 32, the pad 10 deflects downwardly. That is, the openings 24 within the pad 10 become reoriented, i.e., somewhat elongated horizontally, to allow vertical deflection. Moreover, because of the triangular shapes of the openings 24 and the angles of the legs 22, the pad 10 of the present invention has excellent restoring capability. This restoring capability refers to the ability of the pads 10 to decompress and to reassume their original static loaded cross-sectional shape and dimension after impact, and repeatedly over a long term of use. This improved restoring capability results from the truss effect of the angled legs 22.

Thus, within a relatively small vertical profile, the pad 10 of this invention provides a desirable degree of resilient support for the floor 28 above the base 30. And because of the shape of the pad 10, i.e., the transverse shapes of the openings 24 and the legs 22, this pad 10 readily resumes its original static shape, after downward deflection. That is, the angles of the legs 22 help to promote the relocating of the first section 14 in the same position relative to the second section 21, so that they move vertically apart during decompression. These angled legs 22 also make the pad 10 better able to withstand the horizontal, or lateral, sheer forces applied to the pads 10 as a result of horizontal movement of the floorboards 32 relative to the base 30. With the effects of these horizontal forces reduced, the pads 10 help to promote extended use of the floor 28 over a period of time.

In contrast with prior pads of different shape, for instance, pads with rectangularly-shaped passages and vertical supports, the pads 10 of this invention are much less susceptible to eventually becoming incompressible blobs of material. Thus, it is believed that the pads 10 of the present invention will provide a high degree of resiliency for the floor 28 over an extended period of time, due primarily to the shape and orientation of the legs 22 and the triangular openings 24.

While this specification describes a preferred embodiment of the invention, it is to be understood that other variations of the invention are also possible. That is, while the Figures show a presently preferred embodiment of the invention which includes angled legs 22 and triangularly-shaped openings 24 which are right triangles, it is also believed that other triangular-shaped openings and other orientations of the legs 22 may be suitable. Thus, this detailed description of the preferred embodiment should be understood to be an example of the presently preferred embodiment of the invention, and it should not be interpreted as a limitation of the following claims.

I claim:

1. A hardwood floor covering a base comprising:

an upper layer of floorboards;

a subfloor residing below the upper layer; and a plurality of resilient pads supporting the subfloor and upper layer in spaced relation above a base, each of the pads including a first horizontal section contacting the subfloor, a second horizontal section contacting the base and a midsection therebetween, the midsection further including a plurality of legs angled vertically with respect to the first and second horizontal sections and defining a plurality of parallel and horizontally extending openings, the openings being uniform and triangular in transverse cross-sectional shape along their entire lengths and the triangular cross-sectional shape being defined by at least one of the first and second horizontal sections.

2. The floor of claim 1 wherein for each of the resilient pads the legs are oriented such that each of the openings is inverted relative to adjacently located openings.

3. The floor of claim 1 wherein the first horizontal sections have greater surface area contact with the subfloor compared to the surface area contact of the second horizontal sections with the floor, thereby to facilitate attachment of the pads to the subfloor.

4. The floor of claim 1 wherein each of the plurality of resilient pads comprises rubber.

5. The floor of claim 1 wherein the resilient pads are secured to the subfloor by at least one of: a staple, a screw, a nail, a tack and adhesive.

6. A pad for a hardwood floor comprising:

a first section of generally uniform thickness;

a second section of generally uniform thickness and spaced from the first section; and a midsection residing between the first and second sections, the midsection further including a first plurality of legs extending parallel between the first and second sections and angled with respect to a vertical plane, and a second plurality of legs also extending parallel between the first and second sections and angled with respect to the vertical plane but perpendicular to the first plurality of legs, the legs defining a plurality of openings which are uniform and triangular in transverse cross-sectional shape along their entire lengths and the triangular cross-sectional shape being defined by at least one of the first and second sections.

7. The pad of claim 6, wherein the first plurality and the second plurality are each angled about 45° from vertical, in opposite directions.

8. The pad of claim 7 wherein the resilient pads are homogenous in composition.

9. The pad of claim 8 wherein the pads are made of rubber.

* * * * *

UNITED STATES PATENT AND TRADEMARK OFFICE

CERTIFICATE OF CORRECTION

PATENT NO. : 6,718,715 B2
DATED : April 13, 2004
INVENTOR(S) : Paul Elliott

It is certified that error appears in the above-identified patent and that said Letters Patent is hereby corrected as shown below:

Column 3,
Line 12, please delete the word "delectability" and insert the word -- deflectability -- therefor.

Signed and Sealed this

Fourteenth Day of December, 2004

JON W. DUDAS
*Director of the United States Patent and Trademark Office*